United States Patent [19]

Bertelsen

[11] 4,069,771

[45] Jan. 24, 1978

[54] OVAL TABLE WITH UNDIVIDED TABLE TOP

[76] Inventor: Henry Filso Bertelsen, Kibaek Mobelfabrik, DK-6933 Kibaek, Denmark

[21] Appl. No.: 682,154

[22] Filed: Apr. 30, 1976

[30] Foreign Application Priority Data

May 5, 1975 Denmark ..... 1942/75

[51] Int. Cl.[2] ..... A47B 1/05

[52] U.S. Cl. ..... 108/66

[58] Field of Search ..... 108/66, 69, 71, 73, 108/74, 75, 72, 63

[56] References Cited

U.S. PATENT DOCUMENTS

| | | | |
|---|---|---|---|
| 490,936 | 1/1893 | Windeatt | 108/66 |
| 993,539 | 5/1911 | Munz | 108/66 |
| 2,703,740 | 3/1955 | Cochard | 108/66 |
| 3,636,891 | 1/1972 | Bertelsen | 108/66 |
| 3,703,871 | 11/1972 | Bertelsen | 108/66 |

*Primary Examiner*—Roy D. Frazier
*Assistant Examiner*—Darrell Marquette
*Attorney, Agent, or Firm*—Kenyon & Kenyon

[57] ABSTRACT

An oval table is provided with double-lying extensions for folding out to increase the oval shape. These extensions are adapted to be mounted under the main table out of view and to this end, the main table has a downwardly facing edge for concealing the retracted extension leaves. At each end of the oval table is a large double-lying extension leaf whose sliding bars form an angle with the major axis of the oval; at the sides of the oval there are comparatively small double-lying extension leaves whose extension bars are parallel to the minor axis of the oval.

2 Claims, 3 Drawing Figures

Figures 1, 2, 3:
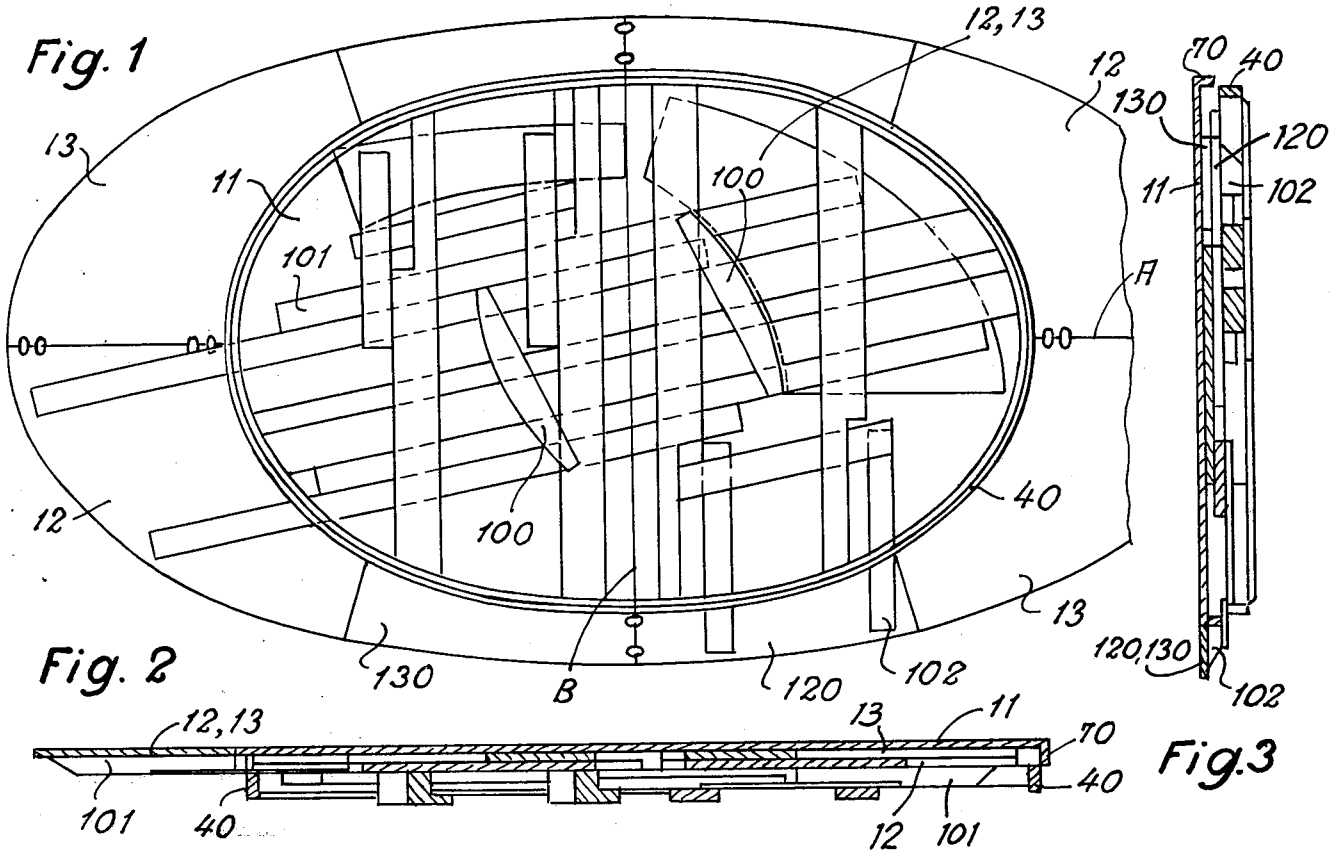

12,13
12
13
11
101
100
40
102
120
130
70
A
B

OVAL TABLE WITH UNDIVIDED TABLE TOP

The invention relates to an oval table with undivided table top, which must not necessarily be oval itself, and with extensions of the draw type, each comprising sliding bars, which are arranged for sliding on the top side of the table frame, and double lying leaves, which are arranged for being turned for location side by side.

The object of the invention is to provide a table with an oval shape in its extended position. This problem has hitherto been difficult to solve on account of the special geometric proportions of an oval table surface.

The table according to the invention is characteristic in that it has at each end of the oval a large double lying extension leaf, the sliding bars of which form an angle with the major axis of the oval, and that it has at the sides of the oval proportionally small double lying extension leaves, the sliding bars of which are parallel to the minor axis of the oval.

It will be seen, that in the embodiment according to the invention it is possible to find place for all the extension leaves, without any part of these projecting under the table top in the inserted position.

According to the invention it is particularly advantageous, that the extension leaves become quite concealed on account of the fact that the table top has a downwards facing edge.

The invention will be explained more detailed with reference to the drawing, in which FIG. 1 shows an embodiment of the table according to the invention in top view, with the undivided table top removed, FIG. 2 illustrates a section through the table mainly along its major axis, with the table top in place, and FIG. 3 illustrates a corresponding section along the minor axis of the table.

In the drawing the table, the table legs of which have been left out, has a table top 11 (FIG. 2) with a downwards facing edge 70.

The table furthermore has a frame 40 and necessary supporting members such as cross-pieces 100 for the support of or counter rest for sliding bars.

At the ends of the oval of the table there are large double lying hinged extension leaves 12,13 with sliding bars 101 which slope in relation to the major axis 1 of the oval.

At the sides of the oval there are small extension leaves, which are parallel to the minor axis B.

Thanks to the sloping location of the sliding bars 101 it will be possible to place the large extension leaves suitably under the table top 11, and in the space which remains free, the small extension leaves will find unhindered place.

On account of the downwardly facing edge 70 and the frame 40 the extension leaves are not seen in the inserted i.e. retracted or stored position.

By using sliding bars with steel supports as shown in the drawing it is achieved that the table can keep the same height with the leaves inserted and with the leaves extended.

I claim:

1. An oval table having an undivided oval shaped table top having a major longitudinal axis and a minor transverse axis and a downwardly facing peripheral edge;

a frame disposed below said table top for supporting said table top thereon;

four pairs of hinged leaves for selective disposition in an extended position peripherally about said table top and a retracted position below said table top and on said frame, each said pair of leaves being disposed in unfolded relation in said extended position to increase the surface area of the oval table and being disposed in folded relation on each other in said retracted position, said pairs of leaves being disposed in a common horizontal plane in said retracted position, said leaves having two pairs of leaves disposed on said major axis and two pairs of leaves disposed on said minor axis with said leaves on said major axis being larger in surface area than said leaves on said minor axis; and sliding bars slidably mounted on said frame and secured to said pairs of leaves for moving said leaves between said positions, said sliding bars secured to said pairs of leaves on said major axis being disposed at an acute angle to said major axis and said sliding bars secured to said pairs of leaves on said minor axis being disposed parallel to said minor axis.

2. An oval table as set forth in claim 1 wherein said leaves are sized to double the surface area of the table in said extended position.

* * * * *